United States Patent [19]

Miller et al.

[11] Patent Number: 4,702,806

[45] Date of Patent: Oct. 27, 1987

[54] METHOD OF AND APPARATUS FOR RECOVERING A METAL FROM A SOLUTION, NAMELY AN ELECTROLYTE-CONTAINING METAL

[75] Inventors: Gilles Miller, St. Egreve; Yves Rivasson, St. Etienne de Crossey, both of France

[73] Assignee: Surfax (Societe a Responsabilite Limitee), La Tronche, France

[21] Appl. No.: 867,335

[22] Filed: May 23, 1986

[51] Int. Cl.[4] ..... G25C 1/12

[52] U.S. Cl. ..... 204/106; 204/104; 204/114; 204/260; 204/263; 204/264; 204/151; 204/152

[58] Field of Search ..... 204/295, 257, 260, 263, 204/264, 259, 105 R, 292, 151, 152, 130, 109, 276, 106–108, 114, 117–118, 110–111

[56] References Cited

U.S. PATENT DOCUMENTS

| | | | |
|---|---|---|---|
| 881,527 | 3/1908 | Armstrong | 204/295 |
| 1,052,256 | 2/1913 | Hybinette | 204/295 |
| 1,358,858 | 11/1920 | Krejei et al. | 204/295 |
| 2,563,903 | 8/1951 | Zadra | 204/295 |

*Primary Examiner*—R. L. Andrews

*Attorney, Agent, or Firm*—Karl F. Ross; Herbert Dubno

[57] ABSTRACT

A cathode compartment is defined by a pair of filter walls between which a cathode or electrolyzing ionic solution of a metal is received. The electrolysis is forced through this compartment and the current density against an anode outside the compartment is sufficiently high to cause at least some of the metal in solution to deposit as a powder which accumulates in the cathode compartment and augments the effective surface area of the cathode.

17 Claims, 4 Drawing Figures

METHOD OF AND APPARATUS FOR RECOVERING A METAL FROM A SOLUTION, NAMELY AN ELECTROLYTE-CONTAINING METAL

FIELD OF THE INVENTION

Our present invention relates to a method of recovering a solubilized metal from a solution and, more particularly, to an electrolytic process for removing metal from a solution thereof, which can be an electrolyte, and to an apparatus for carrying out that method.

BACKGROUND OF THE INVENTION

The use of cathodic deposition as an electrolytic technique for the extraction of a metal from a solution which, because it is conductive can be termed an electrolyte, has long been known. The technique is currently used to recover precious metals which are in solution in an ionic form for the decontamination of effluents polluted with heavy metals such as cadmium, nickel, copper and mercury and for various analytic purposes.

The known techniques require specially designed electrolysis cells which, because of their cost, frequently cannot be used in a practical manner for the recovery of small quantities of metals.

OBJECTS OF THE INVENTION

It is the principal object of the present invention to provide an improved apparatus for the isolation and extraction of metals from solution by electrolysis which avoids the drawbacks of earlier apparatus for this purpose.

Another object of the invention is to provide a method of and an apparatus for the electrolytic recovery of metals from an electrolyte which can be used effectively for the recovery of small quantities of metals and makes use of electrolysis cells of low cost.

SUMMARY OF THE INVENTION

These objects and others which are attained, in accordance with the invention can be realized with an apparatus utilizing a copper cathode or a cathode of another material which is a good conductor of electricity, which is disposed between two filter walls delimiting a completely closed compartment or cell, hereinafter referred to as a cathode compartment, and fully immersed in the electrolyte or conductive solution containing the metal to be recovered. The solution is electrolyzed to deposit the metal on the cathode so that it is adherent to the cathode or can be detached therefrom, being trapped between the porous filter walls. The filter walls are composed of a material which is not conductive to electricity and the solution containing the metal is continuously passed through the compartment and hence through the filtering surfaces.

During the electrolysis operation, the metal is deposited on the surface of the cathode, either in the form of a coating or in the form of a powder which is retained around the cathode by the filtering surfaces which surround it and which define the cathode compartment in which the particles are retained between the two filter walls.

The use of the two filter walls has been found to be particularly significant because they permit use of high current densities which accelerate the electrolytic process but which also have a tendency to produce powder deposits of the metal which detach from the cathode and, which as a consequence, could be entrained in the suspension in the solution.

Thus, with the use of the device of the invention, the particles are not lost, nor can they pose a problem elsewhere, because they are retained in the cathode compartment delimited between the filter walls. It may be noted that the volume of the cathode compartment is not critical and will depend only on the quantity of material to be recovered.

The invention thus provides that no electrolyte/cathode contact can occur outside the region of the cathode surface comprised between the filter walls. Preferably the sense of the electrolyte circulation is such that the solution is directed from the anode which is inert with respect to the electrolysis and neither dissolves therein nor has a metal deposit formed thereon, to a cathode, the cathode being disposed within the cathode compartment at the greatest possible distance from the anode to favor adhesion of the pulverulent material to the cathode or its formation in the cathode compartment.

The rate of flow of the liquid is selected so that it has a comparatively high value of the order of 10 to 40 liters per minute per $dm^2$ of the cathode surface, a value which has been found to give highly effective results permitting a reduction in the cathode surface area to a very substantial extent with respect to the surface area of the cathodes of traditional electrolysis cells.

The circulation of the solution can be effected by means of a pump and is such that the electrolyte, after being forced under pressure into the filtration chamber, passes under pressure through one filtering wall of the cathode compartment where it is subjected to a high degree of turbulence around the cathode. The liquid then leaves through the other wall of the cathode compartment. The pressure and flow rate of the electrolyte should be such that the volume of the cathode compartment is renewed every 1 to 10 seconds.

Because of the rapid formation of a deposit on the reduced-surface cathode generated by the high current density, the cathode is protected by the deposit and is capable of easily resisting chemical attack by highly aggressive electrolysis.

The device of the invention has two important characteristics:

(a) The electrolyte traverses the electrolysis cell delimited by the two filter walls so that the renewal of the layer of liquid in contact with the cathode is very rapid and is brought about simultaneously over the entire cathode surface; and (b) The cathode is a cathode whose surface grows by reason of the fact that the nonadhering metallic deposit on contact with the copper cathode surface is trapped between the filter walls and becomes cathodic in turn. At the end of electrolysis, therefore, the active cathodic surface is significantly increased with respect to the original cathodic surface area. Thus for a given current amplitude the cathodic current density tends to decrease with time. In addition this current density decreases from the exterior toward the interior which favors selective extraction of metallic impurities from a galvanic solution and enables substantial complete recovery of metal from the solution, i.e. even removal of traces thereof.

We have found that metals can be simply and practically recovered without losses if the filter walls are composed of a dielectric material which is completely combustible having a thickness between substantially 2 and 20 mm and having pores of a diameter comprised between 1 and 50 microns, where the cathodic surface initially is comprised between 1 and 10 $dm^2$.

The cell can be burned to eliminate the porous filter walls leaving only the recovered metal which can be easily separated from the copper of the cathode.

According to the chemical nature of the electrolyte and the concentration of the metal in solution, the cathodic current density should be between 0.1 and 20 $A/dm^2$. A method of recovering a metal from an electrolyte according to the invention can thus comprise the steps of:

(a) forming a cathode compartment in a vessel by disposing a cathode of a highly electrically conductive material between two filter walls of electrically nonconductive material;

(b) continuously circulating the electrolyte through the cathode compartment; and (c) electrolyzing the electrolyte between the cathode and an anode in contact with the electrolyte with a current density sufficient to deposit the metal upon the cathode in both an adherent deposit and particulate metal which sloughs from the cathode while the electrolyte is continuously circulated through the filter walls and the compartment.

In a specific embodiment of the invention, the two filter walls are of a cylindrical configuration and are disposed concentrically to one another being connected at their ends by two disks formed from an electrically insulating material and of which one has a diameter equal to the outer diameter of the outer wall and is free from a central bore, i.e. is plain and planar. The other disk having the same outer diameter, is formed with a central passage which can be traversed by the liquid and around this passage has an annular axially extending flange of a diameter substantially equal to the inner diameter of the inner wall. The cathode is received in the annular space defined between two walls and is connected to a conductor passing through one of the two disks.

In the case that the circulation of the electrolyte is oriented from the exterior toward the interior of the cell delimited by the cylindrical filter walls, the outer wall serves to increase the velocity of the solution and thus improves the packing of the metal particles which are deposited against the cathode which can lie closer to the inner wall.

The assembly formed by the filter walls, the cathode and the disks, most advantageously, can conform to the dimensions of the standard filter cartridge and can be of the same dimensions as such a cartridge, e.g. a cartridge used for deionization or water purification.

Such a cartridge can thus be mounted in a conventional cylindrical filter chamber or vessel which previously can be provided with an anode, preferably of a type which is insoluble in the electrolyte and located in a space between the cartridge and an outer wall of the chamber whose cover can be modified to permit passage of the electrical conductors running to the anode and to the cathode.

In a preferred construction of the cathode, it is constituted by two rods or bars which are spaced apart and composed of a conductive material such as copper, disposed longitudinally with the inner wall and maintained in contact with it by a wire conductor of copper which passes helicoidally around this wall and has its turns soldered or otherwise in conductive contact with each rod. One of the rods can have a length at most equal to that of the filtering walls while the other rod has a length greater than this so that the additional length traverses one of the disks to form the aforementioned conductor.

The apparatus because of its simplicity, moderate cost and higher performance has been found to make it economical for the recovery of a metal, for example 20 to 50 grams of gold, in a single operation for the disposable electrolysis cell. Apart from the recovery of precious metals from ionic solution, especially gold, silver and platinum, the apparatus is particularly advantageous for the decontamination of effluents polluted with heavy metals such as cadmium, zinc, lead, copper, etc. for the regeneration of baths saturated with copper and other metals used for scouring or pickling of copper and copper alloys.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
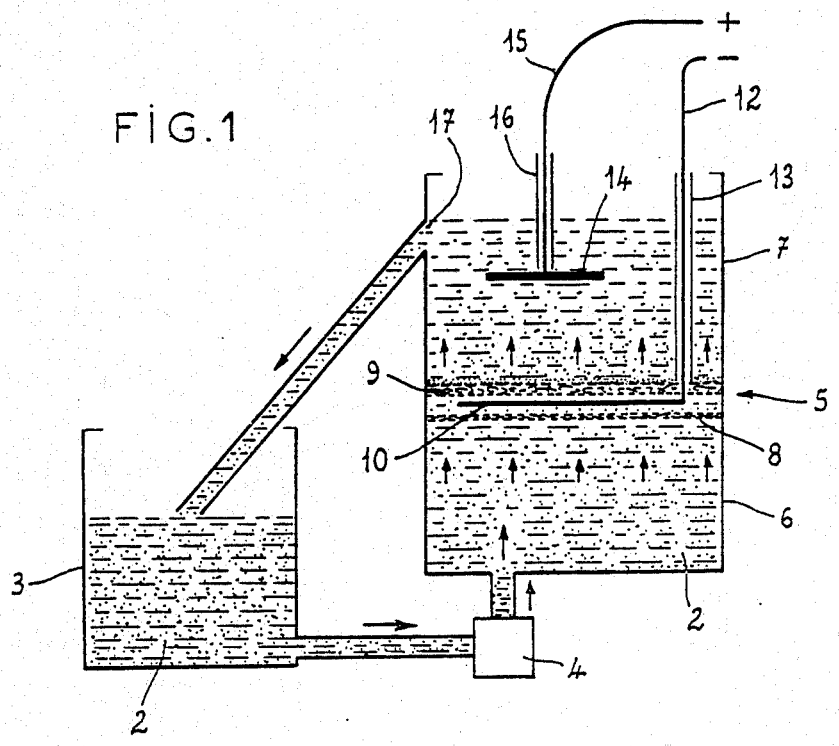
FIG. 1 is a highly diagrammatic cross sectional view of the principal components of an apparatus serving to illustrate the function thereof in the process for recovering metal from solution according to the invention.

As can be seen from FIG. 1, the solution of electrolyte 2 to be treated is contained in a reservoir 3 and is displaced by a centrifugal pump 4 upwardly through a filtration chamber or vessel 5.

The vessel 5 is divided into two chambers, namely a lower chamber 6 and an upper chamber 7 by two horizontal filter walls which are parallel to one another and define between them an electrolysis cell or compartment. These filter walls are constituted respectively by a lower filter wall 8 and an upper filter wall 9.

Within the electrolysis cell or cathode compartment and disposed parallel to the two walls 8 and 9 is a cathode 10 which may be constituted of copper.

The cathode 10 is connected to the negative pole of a source of direct current by a wire conductor 12 extending through a sealing sleeve of tube 13 preventing contact between the wire 12 and the electrolyte 2. Within the upper compartment 7, moreover, there is disposed an anode 14, e.g. of insoluble metal, for example, stainless steel or titanium or of graphite. The anode 14 is connected to the positive pole of a direct current source by a wire 15 extending through an insulating sleeve 16 over the portion of this conductor which lies in the upper chamber of the filter vessel.

The vessel is provided at its upper end with an opening into an overflow conducting liquid back to the reservoir 4.

Apart from the copper cathode and the anode, all of the parts of the apparatus can be composed of an electrically insulating material.

The filter walls 8 and 9 are constituted of a porous material such as a porous plastic or a felt or mat of flexible or fibrous material, stiffened by a perforated plastic wall.

The thickness of the filter wall can be between 2 and 10 mm while the diameter of the pores therein can range between 1 and 50 microns.

In a practical example, a direct current voltage of 5 volts is applied across the electrodes 10 and 14. The pump 4 causes the electrolyte to traverse the filter walls 8 and 9 and pass into contact with the cathode at a flow rate of the order of 10 to 40 1/min per $dm^2$ of the cathodic surface, the cathodic current density being of the order of 0.1 to 20 $A/dm^2$. During electrolysis, the deposited metal, part coated onto the cathode and part following from it in a powder form, is retained around the cathode by the flow of the liquid through the cathode compartment. The particles are captured on the surface and in the pores of the wall 9 and can eventually fill the space between the two walls 8 and 9.

Figure 2:
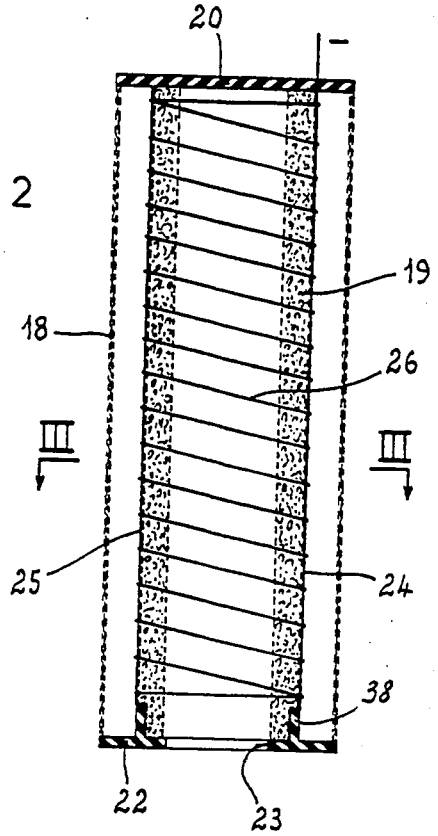
FIG. 2 is an axial section through an electrolysis cell for another embodiment of the invention.
Figure 3:
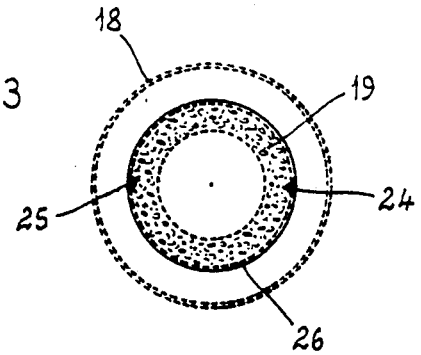
FIG. 3 is a transverse section through the latter cell taken along the line III—III of FIG. 2.

FIGS. 2 and 3 show an embodiment of an electrolysis cell constituted by two filter walls and the cathode.

This cell comprises the two cylindrical filter walls 18 and 19 which are concentric with one another and with the cathode and which each have a length of 250 mm in the specific example. The diameter of the outer wall 18 can be 70 mm, the diameter of the inner wall 19 can be 30 mm, the thickness of the outer wall 18 can be 2 mm and the thickness of the inner wall 19 can be of the order of 5 to 7 mm. The two walls 18 and 19 are fixed to one another by two disks 20 and 22 attached at the ends of the cylindrical walls. The disk 20 is in the form of a plain disk while the disk 22 is provided with a crown surrounding a central opening 23, the crown being formed by an axially extending annular flange 38.

The diameter of the opening 23 is substantially equal to the inner diameter of the inner wall while the outer diameter of the flange 38 is substantially equal to the outer diameter of the inner wall. Along the outer surface of the inner wall, two rods or bars 24 and 25 of copper are disposed, each of these bars having a diameter of the order of 4 mm. The length of the bar 25 is of the order of 200 mm while that of the bar 24 is of the order of 300 mm so that a conductor is formed by the latter bar which traverses the disk 20 to provide an electrical connection to the cathode.

The bars 24 and 25 are fixed on the tube 19 forming the inner filter wall by means of a copper wire 26 wrapped helicoidally around this tube and the bars 24, 25. The turns of the helix can be soldered to the bars if desired. The length of the copper wire is calculated so that it, together with the surface of the bars 24, 25 forms a cathode with a surface area of the order of 1 $dm^2$.

The space defined between the walls 18 and 19 are bounded by the disks 20 and 22, containing the cathode 24–26 forms an electrolysis or cathode cell which can have precisely the dimensions and external configuration of a filter cartridge used in a conventional water filtration apparatus.

The cell advantageously is composed of a combustible material.

This cell, as shown in detail in FIGS. 2 and 3, can be mounted within a cylindrical filtration vessel 27, also of standard dimensions, modified to receive an insoluble anode 28 which is disposed between the cartridge and the inner wall of the chamber. It is merely necessary to move the cover 29 of this vessel to permit passage of the anode and cathode conductors without shorting, and enable the connection of the anode and cathode to a controllable direct current source.

Figure 4:
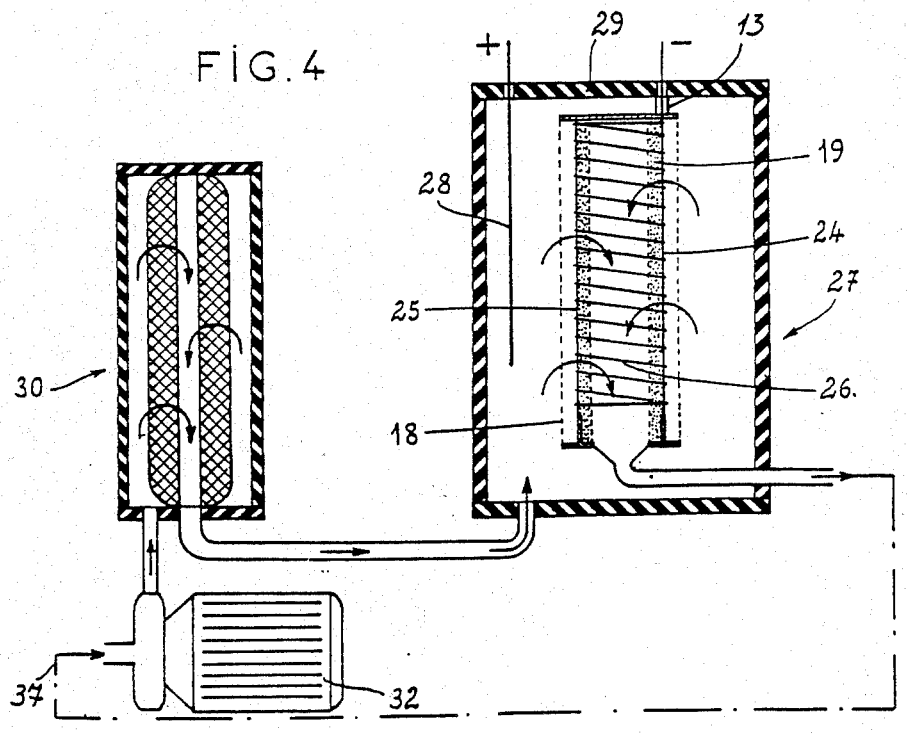
FIG. 4 is a sectional view of another apparatus according to the invention utilizing the cell of FIGS. 2 and 3.

The apparatus comprises, in addition, a prefiltration chamber 30 and a centrifugal pump 32, as shown in FIG. 4, forcing the electrolyte from the exterior inwardly through the cartridge.

The liquid withdrawn from the center of the cartridge axially can be recycled by the pump 32 as represented by the dot-dash line 37.

SPECIFIC EXAMPLE

An electrolyte containing 1.25 grams of gold in 1000 liters of an acid solution is circulated through the apparatus of FIG. 4, utilizing the filter 30 to remove suspended solid particles from the solution:

The electrolyte is pumped at a rate of 2000 liters per hours and the mean current is 20 amperes. The surface area of the cathode is 1 $dm^2$ and the voltage applied between anode and cathode is about 5 volts. The process is carried out at room temperature. The residual gold content in solution is analyzed every 10 hours with the following results:

| T (hours) | 0 | 10 | 20 | 30 | 40 | 60 |
|---|---|---|---|---|---|---|
| Amount of gold in solution g/l | 1.25 | 0.45 | 0.25 | 0.15 | 0.005 | 0.004 |

From this table it can be seen that after 60 hours, the solution can be considered effectively free from the gold.

The electrolyte is then drained and the cartridge is calcined to destroy the combustible portions leaving only the metal which is melted and cast in an ingot containing more than 95% gold. There is practically no significant loss of gold and the cartridge of the dimensions stated can be used to recover more than an kilogram of gold. With recovery of 20 to 50 grams of gold, the process utilizing such a cartridge pays for itself.

It will be apparent, therefore, that the invention provides a significant improvement over preexisting technology for the recovery of metals in that it allows a relatively simple device of low cost and high performance to permit the recovery of metals from ionic solutions more effectively than has hitherto been the case. Naturally modifications of the process and apparatus described can be used within the spirit of the appended claims and we may mention that, for example, the cathode can be constituted in the embodiment of FIGS. 2–4 of a metallic solution provided with regularly spaced openings to allow passage of the electrolyte.

We claim:

1. A method of recovering a metal selected from the group which consists of gold, silver, platinum cadmium, zinc, lead and copper, from an electrolyte, comprising the steps of:

(a) forming a cathode compartment in a vessel by disposing a cathode of a highly electrically conductive material between two filter walls of electrically nonconductive material;

(b) continuously circulating said electrolyte through said cathode compartment by forcing said electrolyte through one of said walls into said compartment, into contact with said cathode and in turbulent flow through said compartment and then out of said compartment through the other of said walls; and (c) electrolyzing said electrolyte between said cathode and an anode in contact with said electrolyte substantially exclusively in said compartment with a current density sufficient to deposit said metal upon said cathode in both an adherent deposit and particulate metal which sloughs from said cathode while said electrolyte is continuously circulated through said filter walls and said compartment so that said particulate metal collects on said other wall in a porous deposit of particles.

2. The method defined in claim 1 wherein said cathode is composed of copper, said electrolyte is passed through said filter walls and said compartment at a flow rate of substantially 10 to 40 1/min per $dm^2$ of surface area of said cathode, said cathode has a surface area between substantially 1 to 10 $dm^2$, said filter walls are composed of a dielectric material with a thickness of substantially 2 to 20 mm, and the filter walls have pores of a pore diameter of 1 to 50 microns.

3. The method defined in claim 2 wherein said current density is between substantially 0.1 and 20 $A/dm^2$.

4. The method defined in claim 1 wherein all of the materials constituting said compartment are combustible, further comprising the step of recovering the metal deposited in said compartment between said walls by combusting said compartment after it has been removed from said electrolyte, leaving said metal as a residue.

5. The method defined in claim 1 wherein said electrolyte is caused to flow through said vessel from said cathode toward said anode and said anode is positioned in said vessel at the greatest possible distance from said cathode.

6. The method defined in claim 1 wherein said filter walls coaxially enclose said cathode and are cylindrical to define a cylindrical compartment, said electrolyte being caused to flow through said compartment from the exterior inwardly.

7. The method defined in claim 1 wherein said electrolyte is circulated through said compartment with a pressure and flow rate sufficient to renew the volume of said electrolyte in said compartment every 1 to 10 seconds.

8. An apparatus for recovering a metal selected from the group which consists of gold, silver, platinum cadmium, zinc, lead and copper, from an electrolyte, comprising:

means including two spaced-apart porous particle-retentive filter walls of electrically nonconductive material forming a cathode compartment in a vessel:

a cathode of a highly electrically conductive material disposed in said compartment between said walls;

means for continuously circulating said electrolyte through said cathode compartment by forcing said electrolyte through one of said walls into said compartment, into contact with said cathode and in turbulent flow through said compartment and then out of said compartment through the other of said walls; and means for electrolyzing said electrolyte between said cathode and an anode in contact with said electrolyte with a current density sufficient to deposit said metal upon said cathode in both an adherent deposit and particulate metal which sloughs from said cathode while said electrolyte is continuously circulated through said filter walls and said compartment so that said particulate metal collects on said other wall in a porous deposit of particles.

9. The apparatus defined in claim 8 wherein said cathode is composed of copper, said electrolyte is passed through said filter walls and said compartment at a flow rate of substantially 10 to 40 1/min per $dm^2$ of surface area of said cathode, said cathode has a surface area between substantially 1 and 10 $dm^2$, said filter walls are composed of a dielectric material with a thickness of substantially 2 to 20 mm, and the filter walls have pores of a pore diameter of 1 to 50 microns.

10. The apparatus defined in claim 9 wherein said current density is between substantially 0.1 and 20 $A/dm^2$.

11. The apparatus defined in claim 8 wherein all of the materials constituting said compartment are combustible.

12. The apparatus defined in claim 9 wherein said electrolyte is caused to flow through said vessel from said cathode toward said anode and said anode is positioned in said vessel at the greatest possible distance from said cathode.

13. The apparatus defined in claim 12 wherein said filter walls coaxially enclose said cathode and are cylindrical to define a cylindrical compartment, said electrolyte being caused to flow through said compartment from the exterior inwardly.

14. The apparatus defined in claim 13 wherein said filter walls are joined at their ends by a pair of disks of electrically insulating material having outer diameters equal to the diameter of the outermost one of said walls, one of said disks being planar and solid, the other of said disks having a central opening surrounded by an annular axially extending flange of a diameter substantially equal to the diameter of the innermost of said walls, said cathode being disposed between said walls and being connected to an electrolyzing current source by a conductor extending through one of said disks.

15. The apparatus defined in claim 14 wherein said filter walls, said disks and said cathode form a standard-size cartridge removable insertable in said vessel.

16. The apparatus defined in claim 14 wherein said cathode is formed by two conductive rods received at least in part in said compartment, one of said rods having a length substantially equal to that of said walls, the other of said rods having a length greater than that of said walls to form said conductor, and a plurality of turns of a conductive wire helix connecting said rods together.

17. The apparatus defined in claim 8 wherein said electrolyte is circulated through said compartment with a pressure and flow rate sufficient to renew the volume of said electrolyte in said compartment every 1 to 10 seconds.

* * * * *